US008123890B2

(12) United States Patent
Tsai et al.

(10) Patent No.: US 8,123,890 B2
(45) Date of Patent: Feb. 28, 2012

(54) PROCESS FOR PREPARING AN ELASTIC NONWOVEN WEB

(75) Inventors: De-Sheng Tsai, Tainan (TW); Te-Hsin Tsai, Tainan (TW)

(73) Assignee: E.I. Dupont de Nemours and Company, Wilmington, DE (US)

( * ) Notice: Subject to any disclaimer, the term of this patent is extended or adjusted under 35 U.S.C. 154(b) by 0 days.

(21) Appl. No.: 12/687,523

(22) Filed: Jan. 14, 2010

(65) Prior Publication Data

US 2010/0109193 A1 May 6, 2010

Related U.S. Application Data

(62) Division of application No. 10/780,781, filed on Feb. 18, 2004, now Pat. No. 7,713,894.

(30) Foreign Application Priority Data

Dec. 5, 2003 (EP) ..... 03028126

(51) Int. Cl.
*B29C 55/06* (2006.01)

(52) U.S. Cl. ..... 156/229; 264/288.4

(58) Field of Classification Search ..... 156/229; 264/288.4, 290.5

See application file for complete search history.

(56) References Cited

U.S. PATENT DOCUMENTS 5,244,482 A 9/1993 Wadsworth et al.

(Continued)

FOREIGN PATENT DOCUMENTS

EP 0 844 323 5/1998

(Continued)

OTHER PUBLICATIONS

European Search Report corresponding to European Patent Application No. EP 03 02 8126, mailed on May 21, 2004.

*Primary Examiner* — Michael Tolin

(74) *Attorney, Agent, or Firm* — Myers Bigel Sibley & Sajovec PA

(57) ABSTRACT

A process of preparing an elastic thermally bonded nonwoven web, whereby the process is characterized by the following steps:

(i) providing a thermally bonded nonwoven precursor web containing thermoplastic fibers, (ii) subjecting the precursor web of step (i) to a drawing treatment in a machine direction at a drawing rate of from 45 to 70%, and a strain rate within a range of from 1000 to 2400%/min at a temperature between the softening point and the melting point of the fibers for preparing the elastic thermally bonded nonwoven web.

20 Claims, 4 Drawing Sheets

U.S. PATENT DOCUMENTS 5,582,903 A 12/1996 Bolian et al.
5,599,366 A 2/1997 Wadsworth et al.
5,814,569 A 9/1998 Suzuki et al.
5,913,997 A 6/1999 Kunze et al.
2003/0200636 A1* 10/2003 Morman et al. ..... 28/170

FOREIGN PATENT DOCUMENTS

GB 2 096 048 10/1982

* cited by examiner

PROCESS FOR PREPARING AN ELASTIC NONWOVEN WEB

STATEMENT OF PRIORITY

This application is a divisional application of U.S. application Ser. No. 10/780,781, filed on Feb. 18, 2004, now U.S. Pat. No. 7,713,894, which claims priority under 35 U.S.C. §119(a) to European Patent Application Serial No. EP 03 028 126.5, filed Dec. 5, 2003, the disclosures of which are incorporated herein by reference in their entireties.

FIELD OF THE INVENTION

The present invention relates to a process for preparing an elastic thermally bonded nonwoven web or fiber mat and an elastic thermally bonded nonwoven web or Fiber mat prepared by the process according to the invention. The present invention also relates to the use of the elastic thermally bonded nonwoven web or fiber mat prepared according to the invention in the manufacture of a disposable sanitary protection product, a medical product, a protective work-wear or a personal use item. Finally, the present invention relates to a product containing the elastic nonwoven web or fiber mat of the invention.

BACKGROUND OF THE INVENTION

Thermally bonded nonwoven webs are well known in the art (Wendt, Industrial and Engineering Chemistry Volume 48, No. 8 (1965) pages 1342; U.S. Pat. No. 3,978,185, U.S. Pat. Nos. 3,795,571; 3,811,957). Stretching of nonwoven webs is described in U.S. Pat. No. 3,772,417, U.S. Pat. No. 4,048,364, U.S. Pat. Nos. 4,223,059, 3,949,127, U.S. Pat. No. 4,276,336, U.S. Pat. No. 5,296,289, U.S. Pat. No. 4,443,513 and EP 0 882 147. However, none of these disclosures relates to the causal connection of stretching of a nonwoven web and imparting elastic properties.

Thermally bonded nonwoven webs are conventionally used for the mass production of disposable sanitary protection products such as adult and infant diapers or sanitary napkins, medical products such as masks, operating gowns, head covers or operating drapes; protective work-wear such as coveralls, head covers and masks; and personal use items such as underwear. A major deficiency of nonwoven webs is their lack of elasticity or stretch and conformability. Since conventional thermally bonded nonwoven webs do not have sufficient elastic properties, products containing such nonwoven webs which require elastic properties conventionally further contain latex bands for fastening and fitting. However, proper adjustment of latex straps is difficult to achieve whereby a fit is usually observed which is either too loose or too tight. Moreover, latex straps are allergenic and irritating to the skin to some degree. Additionally, the use of latex and rubber components in huge volume for disposable products has raised serious environmental concerns in view of toxic waste generation such as dioxins and other harmful emissions in the waste incineration process.

Attempts were made in the prior art to provide nonwoven webs having elastic properties. In one approach, elastomers are incorporated into nonwoven webs as films, bands, or threads of natural or synthetic rubber whereby full-web elasticity in two directions is achieved. However, nonwoven webs based on elastomers lack dimensional stability in at least one direction whereby it is difficult to handle such webs in automated manufacturing processes. Moreover, nonwoven webs based on elastomeric fibers are expensive. Therefore, the use of elastomeric fibers poses inherent problems which render them unsuitable for the mass production of disposable products.

An alternative approach for imparting elasticity to a nonwoven web relates to the so-called thereto-mechanical treatments. Thermo-mechanical treatments for imparting elasticity to a nonwoven web are described in U.S. Pat. No. 5,244,482 and EP 0 844 323. Accordingly, a thermally bonded nonwoven precursor web is subjected to a stretching treatment at an elevated temperature in one direction (machine direction) whereby the width of the precursor web shrinks in perpendicular direction (cross direction) resulting in a certain elasticity in cross direction while maintaining non-elastic properties in machine direction. The anisotropic elasticity combining dimensional stability in machine direction and elastic properties in the cross direction facilitates the use of such webs in automated manufacturing processes.

U.S. Pat. No. 5,244,482 disclosed a process for the preparation of a filter material, wherein very high strain rates of at least 2500%/min are used to laterally consolidate the precursor web with resultant width of less than 80% of the precursor. The very high strain rates are shown to change the morphology of the nonwoven web, reduce the pore size and narrow the pore size distribution. Although a degree of elasticity is created, the elastic modulus is low (70% recovery at 50% elongation, 40% recovery at 100% elongation). We already learn a low draw ratio will not make a high stretchy resultant web. The required strain rates mean in a continuous process, that a high draw ratio with a high processing speed of from 1000 to 4000 m/min are unlikely to be achieved in practice. Moreover, the resultant fabrics is stiff and with specially selected precursors whereby mass production of disposable products based on the material of U.S. Pat. No. 5,244,482 is not possible.

EP 0 844 323 discloses a process wherein a nonwoven web is stretched under low strain rates of from 350 to 950%/min and carefully controlled thermal process conditions for creating a degree of elasticity (85% recovery at 50% elongation) within the precursor web. However, the degree of elasticity of the resultant webs turned out to be still insufficient for meeting the standards required for commercially successful applications. Moreover, although the process of EP 0 844 323 may be carried out in a continuous mode, the maximum process speed attainable is well below 100 m/min whereby mass production cannot be considered economical.

DISCLOSURE OF THE INVENTION

It is the problem of the present invention to overcome the drawbacks of the prior art and to provide a cost effective process of mass producing an elastic thermally bonded nonwoven web having elastic properties in cross direction with high stretchability and recovery.

It is a further problem of the invention to provide a process wherein the processing speed is at least 100 m/min, preferably in a range of from 200 to 400 m/min.

It is a further problem of the invention to provide a novel elastic nonwoven web having high stretchability in cross direction of over 100% with recovery of more than 70%. Moreover, it is a further problem of the invention to provide a novel elastic nonwoven web having high stretchability in cross direction of over 150% with recovery of more than 60%.

It is a further problem of the present invention to provide novel products containing the elastic nonwoven web of the present invention.

These problems are solved according to the claims. Accordingly, the present invention provides a process of preparing an elastic thermally bonded nonwoven web, whereby the process is characterized by the following steps:

(i) providing a thermally bonded nonwoven precursor web containing thermoplastic fibers, (ii) subjecting the precursor web of step (i) to a drawing treatment in a machine direction at a drawing rate of from 45 to 70%, and a strain rate within a range of from 1000 to 2400%/min at a temperature between the softening point and the melting point of the fibers for preparing the elastic thermally bonded nonwoven web.

For the drawing treatment, the web is heated to a temperature above the softening point where a thermoplastic fiber looses its room temperature modulus and becomes soft, viscous and transformable.

The present invention is based on the recognition that control of the strain rate alone is insufficient for imparting superior elastic properties to a thermally bonded nonwoven precursor web in a thermo-mechanical treatment. The present invention is further based on the recognition that control of a further measure is essential for obtaining superior elastic properties. The present invention identifies the control of the drawing rate in combination with the control of the strain rate as essential measures for imparting superior elastic properties. The drawing ratio was found to be causal for shrinking the web width and for creating the stretchability and elasticity. A low drawing rate insufficiently reduces the width of the precursor web and imparts less stretchability and elasticity to the finished web. Finally, the present invention is based on the recognition that the control of a combination of the drawing rate of from 45 to 70%, and a strain rate within a range of from 1000 to 2400%/min provides superior elastic properties, notably with nonwoven precursor webs containing polypropylene. Accordingly, elastic properties imparted by a thermo-mechanical treatment to a thermally bonded nonwoven precursor web may be dramatically improved whereby the nonwoven webs show an elasticity in the cross direction of at least 70% recovery from a 100% elongation, and at least 60% recovery from a 150% elongation. Moreover, the nonwoven webs provide unidirectional elasticity wherein the ratio of elongation at break in cross direction to the elongation at break in machine direction is at least 800%. Thermally bonded nonwoven web having such elastic properties were unknown prior to the present invention.

DETAILED DESCRIPTION OF THE INVENTION

Figure 1:
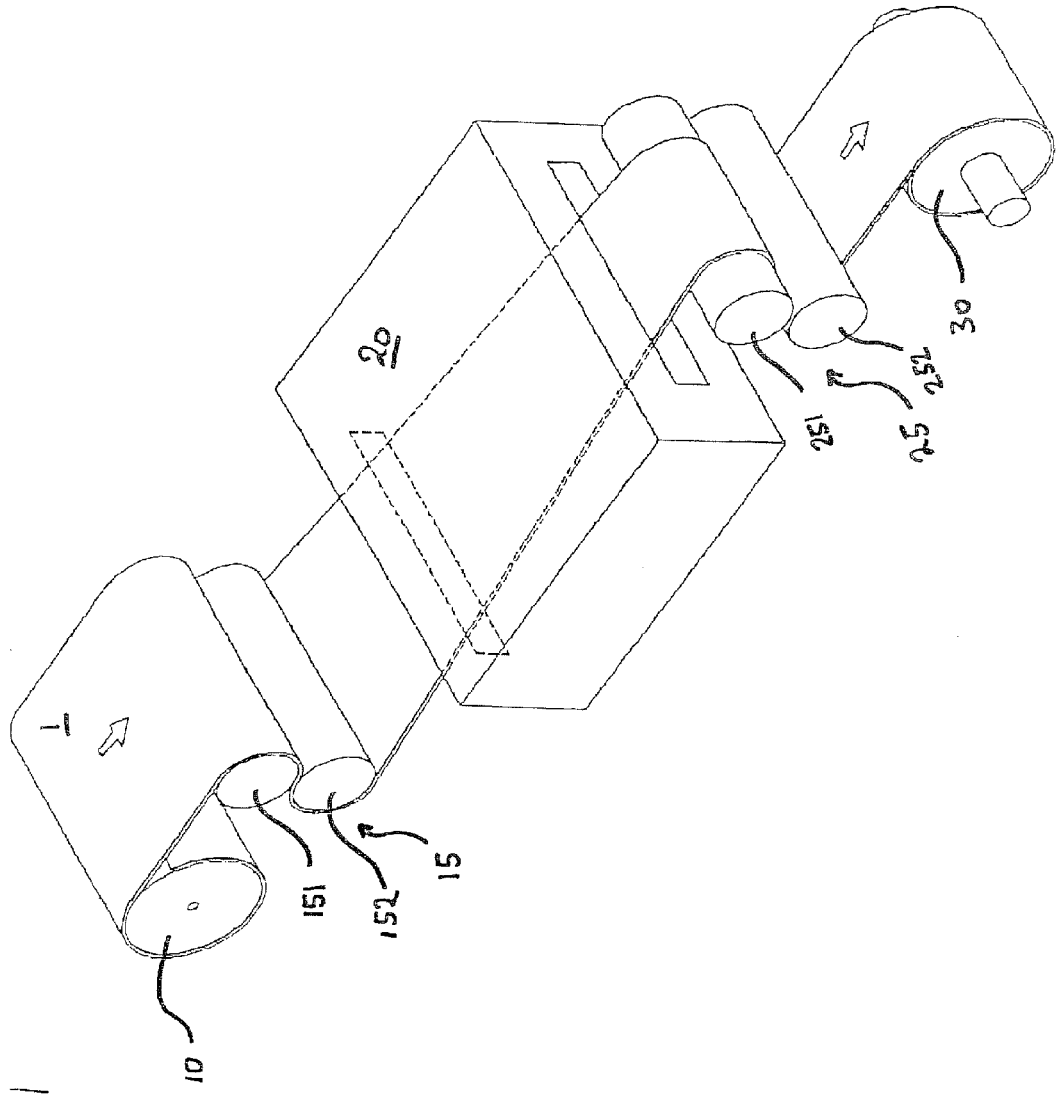
FIG. 1 shows schematically an apparatus for carrying out the process of the invention.

FIG. 1 shows schematically an apparatus for carrying out the process of the invention. The apparatus comprises an unwinding roll (10) and a winding roll (30) provided essentially in parallel orientation for allowing transfer of a web (1) from the unwinding roll (10) to the winding roll (30). The winding roll (10) preferably has a width corresponding to the width (a) of the precursor web prior to the stretching treatment. The winding roll preferably has a width corresponding to the width (b) of the web after the drawing treatment. Since the width of the web (1) decreases during the drawing treatment, the unwinding roll (10) has a greater width than the winding roll (30). The unwinding roll (10) and the winding roll (30) may be rotated around their longitudinal axis. The rotation may be controlled independently for the unwinding roll (10) and the winding roll (30). The unwinding roll supports a nonwoven web (1). The nonwoven web extends from the unwinding roll (10) to the winding roll (30) through a heating means (20) such as an oven. Preferably, a first S-wrap (15) comprising guiding roll (151) and guiding roll (152) is provided between the unwinding roll (10) and the heating means (30). Moreover, a second S-wrap (25) comprising guiding roll (251) and guiding roll (252) is provided between the heating means (20) and the winding roll (30). The nonwoven web supported by the unwinding roll (10) corresponds to a precursor web. The precursor web extends from the unwinding roll (10) in machine direction optionally passing S-wrap (15) towards the entrance of the heating means (20). The nonwoven web enters the heating means (20) and extends through the heating means towards the exit of the heating means. Downstream from the heating means, the nonwoven web extends optionally via S-wrap (25) to the winding roll (30). The heating means (20) is provided for heating the nonwoven web to a temperature between the softening point of the thermoplastic fibers of the web and the melting point of the thermoplastic fibers. The S-wraps (15) and (25) are provided for better controlling the movement of the nonwoven web.

Now, the process of the invention will be illustrated based on the apparatus shown in FIG. 1. Accordingly, an elastic thermally bonded nonwoven web is prepared by providing a thermally bonded nonwoven precursor web containing thermoplastic fibers whereby said precursor web is supported by unwinding roll (10). Unwinding roll (10) is rotated around its longitudinal axis whereby the precursor web leaves unwinding roll (10) in machine direction along arrow (MD) at a speed A. The precursor web travels via S-wrap (15) into the heating means (20), through the heating means and from the exit of the heating means via S-wrap (25) to the winding roll (30). Winding roll (30) is driven at a speed higher than the unwinding speed A by a factor of (1+X %). The factor (1+X %) determines the drawing rate of the nonwoven web in the process of the present invention. According to the invention, the precursor web is subjected to a drawing treatment in a machine direction at a drawing rate of from 45 to 70%, and a strain rate with a range of from 1000 to 2400%/min at a temperature between the softening point and the melting point of the fibers in order to allow a consolidation of the fiber structure and a decrease of the width of the nonwoven web. As a result of the drawing treatment, the width of the web decreases in the cross direction (CD). Preferably, the machinery for carrying out the process of the invention is constructed for commercial capacity with an unwinder roll and a winding roll(s) installed in a distance of from 4 to 12 m, preferably about 6 to 10 m, specifically 8 m, and a heating device installed in between. The unwinder advantageously runs at commercial speed of more than 100 m/min and up to 400 m/min, preferably at least 150 m/min and up to 250 m/min, and a draw ratio of 45% to 70% is created by increasing the speed of the winding roll. The strain rates is adjusted to 1000 to 2400%/min, preferably 1200 to 2200%/min. Preferably, the drawing treatment in step (i) comprises introducing the thermally bonded nonwoven web into a heating means for heating the web to a temperature between the softening point and the melting point of the fibers. The drawn web is preferably cooled after the drawing treatment and prior to winding on storage roll.

The web used in the process of the invention preferably contains polypropylene fibers. The amount of the polypropylene fibers in the web is preferably at least 30% by weight. The web may contain further fibers, such as thermoplastic fibers or cellulosic fibers. In a specific embodiment, the web consists of polypropylene fibers. The nonwoven web of the present invention has anisotropic elasticity properties, preferably a ratio of elongation at break in cross direction to the elongation at break in machine direction of at least 800%. The nonwoven web may be a spunbonded web, a melt blown web or a carded thermally bonded nonwoven web, or the nonwoven web may be a laminate containing two or more of the above mentioned nonwoven webs or the web may be a laminates of the above mentioned nonwoven webs and a thermoplastic film. Several kinds of thermally bonded nonwoven webs including carder, spunbond, SMS and SMMS from different producers have been processed and the resultant webs exhibit high stretchability with high recovery in the cross-direction. The cross-direction-only elasticity of these webs truly frees the nonwoven product converting from the need of sewing latex straps in their conventional methods, and the converted products provide sensational easy-fit and stressless comfort to wearer.

The webs of this invention may be a multilayer laminate. An example of a multilayer laminate is an embodiment wherein some of the layers are spunbond and some meltblown such as a spunbond-meltblown-spunbond (SMS) laminate as disclosed in U.S. Pat. No. 5,169,706. SMMS is the laminate of Spunbond-meltblown-meltblown-spundbond. Such a laminate may be made by sequentially depositing onto a moving forming belt first a spunbond fabric layer, then a meltblown fabric layer and last another spunbond layer and then bonding the laminate in a spotbinding device. Alternatively, one or more of the fabric layers may be made individually, collected in rolls, and combined in a separate bonding step.

The web of carded or thermalbond described in this invention is obtainable by mixing and carding staple fibers for formed a mat then bonded with a spotbonding method.

Preferably, the process of the invention is carried out continuously. The drawing treatment in step (i) of the continuous process according to the invention may comprise unwinding the thermally bonded nonwoven web into a first variable tension means which feeds said web into a web heating means for heating the web to a temperature between the softening point and the melting point of the fibers, followed by continuously stretching the heated web lengthwise in the machine direction, cooling the web and collecting the cooled web. The nonwoven web containing thermoplastic fibers can be softened in the range of temperature prior to melting. In the softened states, a mechanical force can be applied to the web to change its morphology and properties. After the drawing treatment and the cooling below the softening temperature, the finished web exhibits different characteristics from its precursor.

Figure 2:
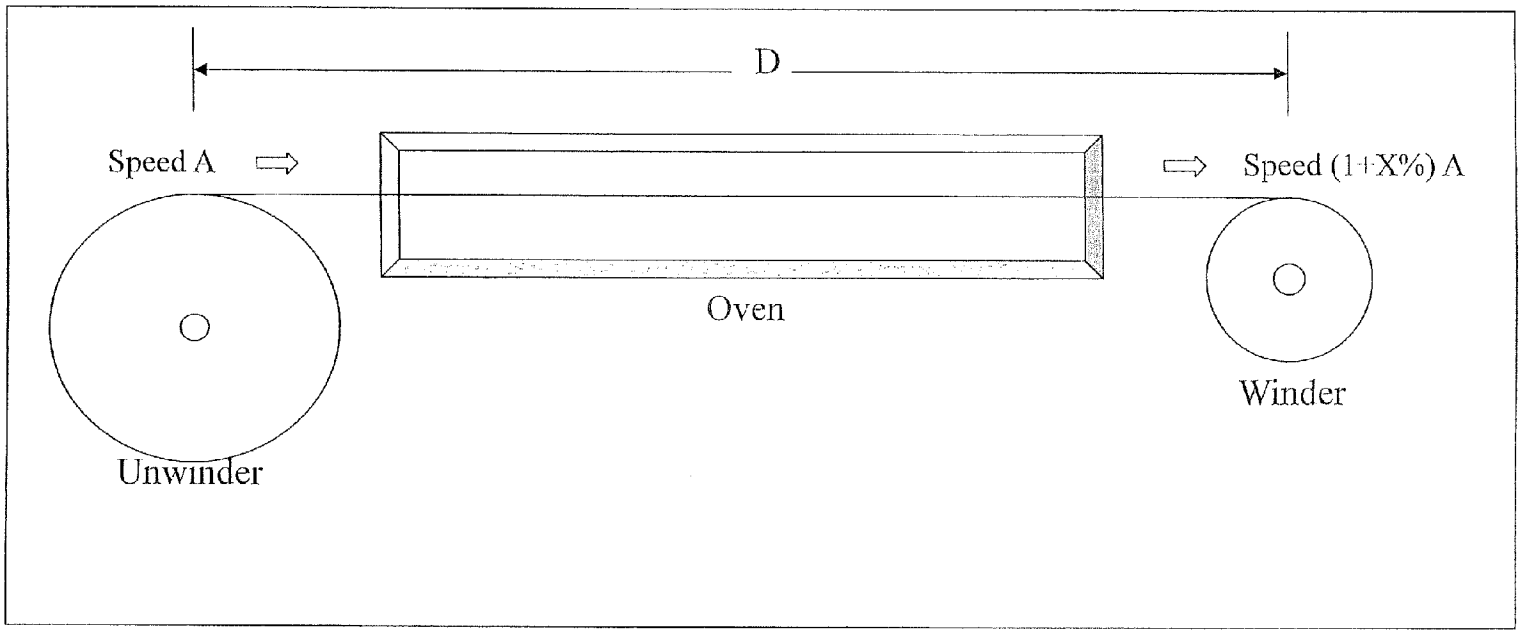
FIG. 2 shows a schematic side view of an apparatus for carrying out the process of the invention.

FIG. 2 shows a schematic side view of an alternative apparatus lacking S-wraps. The apparatus comprises one unwinder and a winder and an oven in between to apply constant heat to a fabric that runs through. The transformation of the nonwoven web is carried out within the distance between the unwinder and winder (D). The strain rate (%/t) is generally described as a piece of fabric being drawn and extended certain (X) percentage in a period of time. The extension percentage can be achieved by the speed ratio of winder to unwinder, and the time period of fabric run through can be calculated by dividing D over the average of unwinder speed (A) and winder speed [(1+X%) A]. Speed A is generally expressed in m/min as:

$$X\%/\{D/[A+(1+X\%)A]/2\}=X\%\{2D/[A+(1+X\%)A]\}=\{X\%\times[A+(1+X\%)A]\}/2D$$

Figure 3:
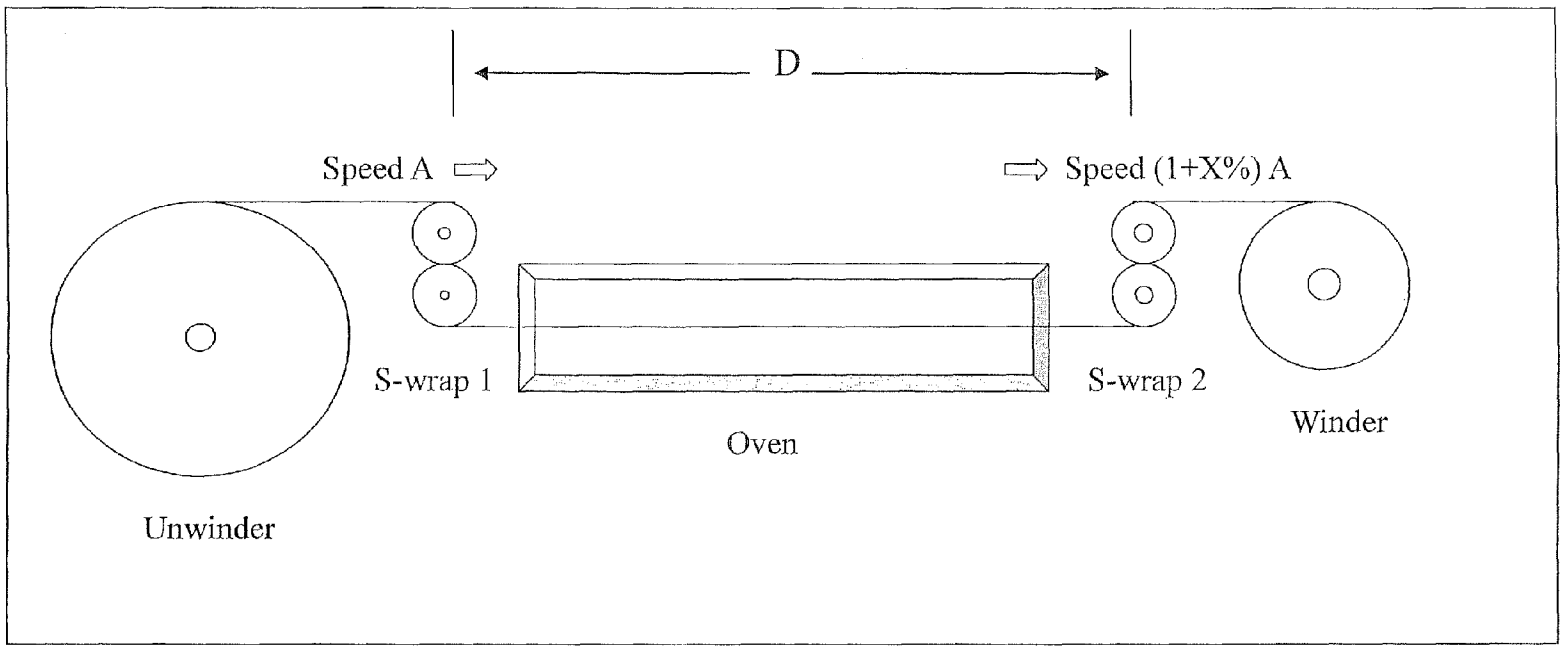
FIG. 3 illustrates shows a schematic side view of a further embodiment of an apparatus for carrying out the process of the present invention.

FIG. 3 illustrates shows a schematic view of a further embodiment of an apparatus for carrying out the process of the present invention. The apparatus includes one S-wrap (15) after unwinder and one S-wrap (25) before winder for stabilizing the fabric feeding through. The transformation of the nonwoven web is carried out within the distance (D) between these two S-wraps. The extension percentage can be achieved by the speed ratio of S-wrap 2 to S-wrap 1, and the time period of fabric run through can be calculated by dividing D over the average of S-wrap 1 speed (A) and S-wrap 2 speed [(1+X %) A].

The present invention also provides an elastic thermally bonded nonwoven web containing polypropylene fibers, which is obtained or obtainable by the process of the present invention. The web elasticity is defined by measuring the variations of a 5-cm wide and 10 cm long strip along the longitudinal axis as follows:

(stretched length−recovered length)/(stretched length−original length).

The elastic thermally bonded nonwoven web preferably has an elasticity in the cross direction of at least 70% recovery from a 100% elongation, and at least 60% recovery from a 150% elongation. In a specific embodiment, the elastic thermally bonded nonwoven web is laminated on an elastomeric film.

The present invention also provides a use of the elastic nonwoven web for the preparation of a disposable sanitary protection product, a medical product, a protective work-wear or a personal use item. The present invention also provides a product containing an elastic nonwoven web of the invention. The product may be is a disposable sanitary protection product, a medical product, a protective work-wear or and a personal use item. The disposable product may be an adult or infant diaper, or a sanitary napkin. The medical product may be a mask, an operating gown, a head cover, or an operating drape. The protective work-wear may be a coverall, a head cover or mask. The personal use item may be underwear.

The process of the invention does not use expensive, allergenic and environmentally unsafe elastomeric fibers for imparting elasticity.

EXAMPLES

Terminology

The basis weight of nonwoven webs is usually expressed in minigram of material per square meter (gsm).

The softening point is the temperature where a thermoplastic fiber looses its room temperature modulus and becomes soft, viscous and transformable to applied force.

As used herein the term "spunbond" refers to the webs formed by small diameter fibers which are formed by extruding molten thermoplastic material as filaments from a plurality of fine, usually circular capillaries of a spinneret with the diameter of the extruded filaments then being rapidly reduced as by, for example, in U.S. Pat. No. 4,340,563 and U.S. Pat. No. 3,692,618, U.S. Pat. No. 3,802,817. U.S. Pat. Nos. 3,338, 992 and 3,341,394, U.S. Pat. No. 3,502,763, U.S. Pat. No. 3,502,538, and U.S. Pat. No. 3,542,615. Spunbond fibers are generally not tacky when they are deposited onto a collecting surface. Spunbond fibers are generally continuous and have average diameters (from a sample of at least ten fibers) larger than 7 microns, more particularly, between about 10 and 30 microns.

Tensile test: The tensile test is a measure of breaking strength and elongation or strain of a fabric when subjected to unidirectional stress. This test is known in the art and conforms to the specifications of Method D5034 of the American Standard Test Methods. The results are expressed in kilograms to break and percent stretch before breakage. Higher numbers indicate a stronger, more stretchable fabric. The term "elongation" means the increase in length of a specimen during a tensile test. Values for grab tensile strength and grab elongation are obtained using a specified width of fabric, usually 3 cm, clamp width and a constant rate of extension. The sample is wider than the clamp to give results representative of effective strength of fibers in the clamped width combined with additional strength contributed by adjacent fibers in the fabric.

Example 1

17 gsm SMS nonwoven fabrics were processed over 8-meters distance between unwinder and winder to show the width reduction under different strain rates and conditions further specified in Table 1. As shown by Table 1, a draw rate over 45% was required to reduce the width by 50%. Upon increase of the speed by 10 m/min, it was required to increase the draw ratio by about 1.5% to maintain the width reduction.

TABLE 1

| Unwinding Speed m/min | Draw Ratio % | Winding Speed m/min | Strain Rate %/min | Width Reducing % |
|---|---|---|---|---|
| 150 | 40 | 210 | 900 | 45.4 |
| | 45 | 218 | 1035 | 52.3 |
| | 50 | 225 | 1172 | 57.7 |
| | 55 | 233 | 1317 | 61.5 |
| | 60 | 240 | 1463 | 62.2 |
| | 65 | 250 | 1625 | 63.1 |
| 200 | 40 | 280 | 1200 | 43.4 |
| | 45 | 290 | 1378 | 51.8 |
| | 50 | 300 | 1563 | 55.7 |
| | 55 | 310 | 1753 | 58.5 |
| | 60 | 320 | 1950 | 60.6 |
| | 65 | 330 | 2153 | 61.8 |
| 250 | 40 | 350 | 1500 | 41.4 |
| | 45 | 363 | 1724 | 50.7 |
| | 50 | 375 | 1953 | 53.6 |
| | 55 | 388 | 2193 | 56.3 |
| | 60 | 400 | 2438 | 57.9 |
| | 65 | 413 | NA | Broke webs |

Example 2

Different basic weights of SMS precursor webs were processed at unwinding speed of 200 m/min and with 50% draw rate. The results shown in Table 2 demonstrate that the draw ratio made similar width reductions to precursor webs with different basic weights.

TABLE 2

| Precursor Basic Weight g/cm$^2$ | Draw Ratio % | Strain Rate %/min | Width Reduction % | Finished Basic weight g/cm$^2$ |
|---|---|---|---|---|
| 16.7 | 50 | 1563 | 56.8 | 26.4 |
| 26.6 | 50 | 1563 | 55.3 | 39.8 |
| 35.4 | 50 | 1563 | 57.1 | 51.3 |
| 52.3 | 50 | 1563 | 55.4 | 68.6 |

Example 3

Nonwoven webs of Spunbond (S), Carded (C) SMS and SMMS were treated at 200 m/min unwinding speed with 30 to 60% draw ratios. It was shown in Table 3 that the draw ratio made the length extension and the width reduction in similar pattern of 30-60% with different thermally bonded nonwoven webs and at least 45% draw ratio was required to reduce 50% of the precursor width.

TABLE 3

| Precursor | Basic weight g/cm$^2$ | Draw Ratio % | Strain Rates %/min | Finished Basic weight g/cm$^2$ | Length Extension % | Width Reducing % |
|---|---|---|---|---|---|---|
| S | 12.7 | 30 | 750 | 15.5 | 1.26 | 34.6 |
| | 12.7 | 40 | 1000 | 17.4 | 1.34 | 45.0 |
| | 12.7 | 45 | 1125 | 18.1 | 1.37 | 50.6 |
| | 12.7 | 50 | 1250 | 19.2 | 1.40 | 52.4 |
| | 12.7 | 60 | 1500 | 21.7 | 1.53 | 59.8 |
| S | 25.6 | 30 | 750 | 28.3 | 1.28 | 32.3 |
| | 25.6 | 40 | 1000 | 33.6 | 1.37 | 43.8 |
| | 25.6 | 45 | 1125 | 34.7 | 1.40 | 50.1 |
| | 25.6 | 50 | 1250 | 36.5 | 1.44 | 50.6 |
| | 25.6 | 60 | 1500 | 40.8 | 1.56 | 58.1 |
| C | 22.6 | 30 | 750 | 31.4 | 1.20 | 38.1 |
| | 22.6 | 40 | 1000 | 33.9 | 1.29 | 49.6 |
| | 22.6 | 45 | 1125 | 35.2 | 1.32 | 52.2 |
| | 22.6 | 50 | 1250 | 36.7 | 1.36 | 55.8 |
| | 22.6 | 60 | 1500 | 41.3 | 1.45 | 61.8 |
| C | 44.3 | 30 | 750 | 56.9 | 1.21 | 37.0 |
| | 44.3 | 40 | 1000 | 67.6 | 1.26 | 49.1 |
| | 44.3 | 45 | 1125 | 69.2 | 1.30 | 52.7 |
| | 44.3 | 50 | 1250 | 70.3 | 1.34 | 54.2 |
| | 44.3 | 60 | 1500 | 74.9 | 1.44 | 60.9 |
| SMS | 15.2 | 30 | 750 | 20.9 | 1.18 | 37.7 |
| | 15.2 | 40 | 1000 | 22.6 | 1.24 | 48.3 |
| | 15.2 | 45 | 1125 | 23.4 | 1.31 | 51.5 |
| | 15.2 | 50 | 1250 | 24.1 | 1.36 | 53.4 |
| | 15.2 | 60 | 1500 | 26.3 | 1.46 | 57.8 |
| SMS | 41.7 | 30 | 750 | 54.4 | 1.15 | 35.5 |
| | 41.7 | 40 | 1000 | 62.5 | 1.20 | 46.1 |
| | 41.7 | 45 | 1125 | 65.2 | 1.31 | 52.2 |
| | 41.7 | 50 | 1250 | 67.2 | 1.42 | 56.4 |
| | 41.7 | 60 | 1500 | 72.6 | 1.51 | 62.3 |
| SMMS | 17.1 | 30 | 750 | 20.5 | 1.17 | 30.7 |
| | 17.1 | 40 | 1000 | 23.8 | 1.25 | 42.5 |
| | 17.1 | 45 | 1125 | 24.4 | 1.31 | 50.3 |
| | 17.1 | 50 | 1250 | 25.6 | 1.37 | 52.2 |
| | 17.1 | 60 | 1500 | 29.1 | 1.48 | 59.4 |
| SMMS | 50.6 | 30 | 750 | 58.7 | 1.26 | 32.9 |
| | 50.6 | 40 | 1000 | 68.8 | 1.34 | 46.2 |
| | 50.6 | 45 | 1125 | 70.4 | 1.38 | 50.1 |
| | 50.6 | 50 | 1250 | 72.8 | 1.41 | 51.6 |
| | 50.6 | 60 | 1500 | 78.3 | 1.52 | 58.3 |

Example 4

Spunbond 35 gsm, Carded 45 gsm and SMMS 25 gsm were used as precursor for processing under different draw ratio to obtain the width reduction from 30% to 60%. The results are shown in Table 4. The elasticities were measured from 50%, 100% and 150% elongation respectively. The resultant webs with width reduction less than 40% are most unlikely be extended for more than 100% and obtained good recovery for over 50%. In contrast, the resultant webs with width reduction over 50% showed recovery more than 70% at 100% elongation and more than 60% at 150% elongation.

TABLE 4

| | Width Reduction % | Strain Rate %/min | Elongation at Break % | Recovery from 50% elongation % | Recovery from 100% elongation % | Recovery from 150% elongation % |
|---|---|---|---|---|---|---|
| Spunbond 43 gsm | 30 | 720 | 89 | 72 | NA | NA |
| Spunbond 47 gsm | 40 | 1050 | 104 | 88 | NA | NA |
| Spunbond 52 gsm | 50 | 1380 | 184 | >95 | 78 | 63 |
| Spunbond 62 gsm | 60 | 1710 | 237 | >95 | 86 | 73 |
| Carded 54 gsm | 30 | 690 | 104 | 75 | NA | NA |
| Carded 60 gsm | 40 | 1020 | 129 | 90 | 24 | NA |
| Carded 67 gsm | 50 | 1350 | 203 | >95 | 73 | 65 |
| Carded 78 gsm | 60 | 1680 | 248 | >95 | 80 | 74 |
| SMMS 28 gsm | 30 | 780 | 93 | 76 | NA | NA |
| SMMS 31 gsm | 40 | 1080 | 115 | 85 | NA | NA |
| SMMS 36 gsm | 50 | 1410 | 197 | >95 | 77 | 66 |
| SMMS 40 gsm | 60 | 1790 | 226 | >95 | 86 | 77 |

Example 5

The results shown in Table 5 further confirmed the high elastic recovery rates of the webs over five stretches for 100% (A) and 150% (B) elongations. The unique high ratio (1000-1400%) of CD/MD elongation at break is also shown.

TABLE 5

| Finished webs | | Spunbond 38 gsm | Carded 40 gsm | SMS 65 gsm | SMMS 70 gsm |
|---|---|---|---|---|---|
| Strain Rate Applied | %/min | 1410 | 1410 | 1410 | 1410 |
| Width reduction | % | 52 | 54 | 53 | 50 |
| Elongation at Break (+%) | MD | 14.6 | 15 | 15.3 | 16.3 |
| | CD | 178 | 210 | 190 | 188 |
| CD/MD Elongation Ratio | % | 1220 | 1400 | 1240 | 1150 |

TABLE 5-continued

| Recovery Ratio for 5 repeated stretches with 100% (A) and 150% (B) elongation | Elongations | A | B | A | B | A | B | A | B |
|---|---|---|---|---|---|---|---|---|---|
| | % | 83 | 68 | 80 | 66 | 78 | 66 | 76 | 63 |
| | | 75 | 62 | 74 | 61 | 73 | 57 | 71 | 55 |
| | | 73 | 60 | 71 | 58 | 70 | 54 | 67 | 50 |
| | | 71 | 57 | 69 | 55 | 68 | 52 | 66 | 47 |
| | | 70 | 55 | 67 | 52 | 66 | 51 | 63 | 45 |

Example 6

The stretchability and recovery were tested with 5-cm strips of treated SMS webs with the claimed high and low limits of strain rates. The results are shown in Table 6. The unique characteristics of cross direction (CD) width reduction, elongation at break, CD/MD elongation ratio and recovery at 100% elongation were measured.

TABLE 6

| | | | | | | | | | |
|---|---|---|---|---|---|---|---|---|---|
| Precursor Basic Weight | ($g/m^2$) | 16.4 | 16.4 | 25.6 | 25.6 | 34.7 | 34.7 | 51.3 | 51.3 |
| unwinding Speed | m/min | 150 | 250 | 150 | 250 | 150 | 250 | 150 | 250 |
| Strain Rate Applied | %/min | 1035 | 2438 | 1035 | 2438 | 1035 | 2438 | 1035 | 2438 |
| Finished Basic Weight | ($g/m^2$) | 23.7 | 28.3 | 35.7 | 42.8 | 47.6 | 56.4 | 64.4 | 76.9 |
| Width reduction | % | 50.7 | 58.8 | 52.1 | 60.6 | 50.4 | 61.2 | 53.2 | 62.4 |
| Elongation (+%) | MD | 19.4 | 16.7 | 18.7 | 15.3 | 21.4 | 16.9 | 20.8 | 16.3 |
| | CD | 162 | 214 | 167 | 223 | 176 | 231 | 184 | 243 |
| CD/MD Elongation Ratio | % | 835 | 1280 | 890 | 1458 | 822 | 1367 | 885 | 1490 |
| Recovery % for 10 stretches at 100% elongation | % | 76 | 83 | 76 | 82 | 73 | 80 | 72 | 77 |
| | | 72 | 78 | 72 | 76 | 68 | 74 | 68 | 71 |
| | | 70 | 76 | 70 | 74 | 66 | 73 | 65 | 68 |
| | | 70 | 74 | 70 | 73 | 63 | 73 | 62 | 67 |
| | | 69 | 73 | 68 | 72 | 62 | 71 | 60 | 66 |
| | | 69 | 73 | 67 | 71 | 59 | 70 | 58 | 65 |
| | | 68 | 72 | 65 | 70 | 59 | 69 | 59 | 64 |
| | | 68 | 72 | 65 | 68 | 59 | 67 | 55 | 64 |
| | | 67 | 72 | 64 | 68 | 58 | 65 | 55 | 63 |
| | | 67 | 70 | 64 | 68 | 57 | 65 | 55 | 63 |

The strain rate is calculated by the percentage of increasing length within the time period of time that makes such increase. The percentage of increasing length is the draw ratio, which is carried out by increasing the winding speed over the unwinder. The time period of making such length increasing is calculated by dividing the distance between the unwinder and the wining roll with the speed of the web passing through, and that speed is an average of unwinder speed and winding speed.

For example, the present invention requires at least 45% draw ratio in a distance of 8 meters between unwinder and winding roll and with a minimal speed of 150 m/min for unwinder, to reduce the width of the precursor web by 50% and become the elastic nonwoven web of the invention. The strain rate in the low limit of the present invention is calculated as:

$$45\%/\{8\text{ m}/[150\text{ m/min}(150\text{ m/min}\times1.45)]/2\}=1034\%/\text{min}$$

wherein (1) 45% is the draw ratio;

(2) 8 m is the distance between unwinder and winding roll that the drawing being created;

(3) 150 m/min is the unwinder speed;

(4) 150 m/min×1.45=217.5 m/min is the winding roll speed;

(5) [150 m/min+(150 m/min×1.45)]/2=183.75 m/min is the averaged travelling speed of the web through the drawing;

(6) 8 m/[150 m/min+(150 m/min×1.45)]/2=0.04354 minute is the time that the drawing happened The 0.04354 minutes (2.61 second) processing time is essential also for the web to pick up the heat and raise its temperature from 25 C to 125° C. for softening.

The higher strain rates can be obtained by processing at high speed and high draw ratio. However, tests in the 8-meter processing distance had revealed that it would be impractical and break the commonly available nonwoven web that containing thermally bonded polypropylene fibers at a draw ratio of over 70% and a winding speed over 500 m/min. In the case, the strain rate was 3500%/min and less than 1.2 second for web to run through 8 meter distance and pick up heat for increasing temperature by 100° C.

Any higher draw ratio or higher speed for higher strain rates as the previous U.S. Pat. No. 5,244,482 inventions described is considered incredible and impossible to be achieved especially for a continuous processing with the current commercial apparatus and on polypropylene nonwoven web. A temperature very close to the melting point was probably used in combination with a very high strain, whereby the resulting web has a width reduction of 80% of the precursor web, but an elongation of only below 120%. Such a fabric would be of little commercial value due to the stiffness, low degree of elasticity (70% recovery at 60% elongation) and very narrow width (if a 420 cm maximum width of a precursor web is used, the resulting web would be only 84 cm in width or less). Additionally, U.S. Pat. No. 5,244,482 places many limitations on selecting the precursor webs by the physical properties as to crystallinity, thermoplastic fiber content, fiber diameter, random fiber deposition, and isotropic tensile properties and the machine direction tensile elongation to break has to be less than 40%. As a matter of fact, the commercially available polyolefin nonwoven webs now even the low 15 gsm material all have the machine direction tensile elongation to break higher than 40%, and there is no commercial application of this art since it was disclosed.

The best result is obtained according to the present invention at 50% draw rate with feeding speed of 200 m/min to make the strain rate at 1600%/min. The average strain rate of the best mode claimed by U.S. Pat. No. 5,244,482 was 4750%/min, and to attain it with an apparatus as shown in FIG. 1 and a 50% drawing rate, the feeding speed would have to be as high as 608 m/min. As tested in an apparatus according to FIG. 1 with the 50% draw rate and with commercially available nonwoven webs, the feeding speed cannot be increased over 400 m/min without breaking the web. As a matter of fact, the maximal feeding speed stated in the experiment of U.S. Pat. No. 5,244,482 was only 122 m/min (400 f/min), then for reaching its best strain rate, the draw rate has to be as high as 250% as it described in content. The inventors of the present invention experienced no higher than 80% draw rate can be made. Accordingly, U.S. Pat. No. 5,244,482 is limited to special precursor webs with strict limitations in the properties of crystallinity, fiber diameter, random fiber deposition, isotropic tensile properties, and low tensile elongation to break.

EP 0 844 323 on the other hand describe a method of using low strain rate that between 350% and 950% per min, low 30% draw rate with speed below 100 m/min. EP 0 844 323 describes clearly that the width reduction of the precursor web was between 30-40% and the finished web has an elasticity for 85% recovery from 50% elongation. Accordingly, the draw ratio would be around 35% or less and that theoretically it should not be possible to stretch the finished web more than 66.7% (100/60) to over the width of its precursor. EP 0 844 323 describes the treatment with multiple sets of drawing rolls to make the accumulated strain rate typically below 950% but above 350% per minute. In fact, the more sections of drawing rolls ae present, the lower the processing speed has to be adjusted to meet the claimed low strain rate range. For example, assuming with the description of EP 0 844 323 a minimal two (2) sets drawing rolls over 8 meters distance and 35% drawing ratio equally made in two sets to make the claimed highest 950%/min strain rate, the maximal feeding speed (x) can be calculated as:

$$17.5\%/[4\text{ m}/(x+1.175x)/2]+17.5\%/\{4\text{ m}/[1.175x+1.175(1.175x)]/2\}950\%/\text{min}$$

$$\text{Equal: }[17.5\%(2.175x)/8\text{ m}]+[17.5\%(2.556x)/8\text{ m}]=950\%/\text{min}$$

$$17.5\%(4.731x)=7600\%\text{ m/min}$$

$$x=91.8\text{ m/min}$$

Processing under such low speed would raise the cost and has little commercial value to meet the applications of mass quantity and low-cost disposable nonwoven products, but any higher processing speed would make the strain rate over its claimed limit. More sets of drawing rolls or lower strain rates would further lower the processing speed. Additionally, the low draw ratio would sure not consolidate the web enough to make the high elasticity as the web resulted from the present invention.

Figure 4:
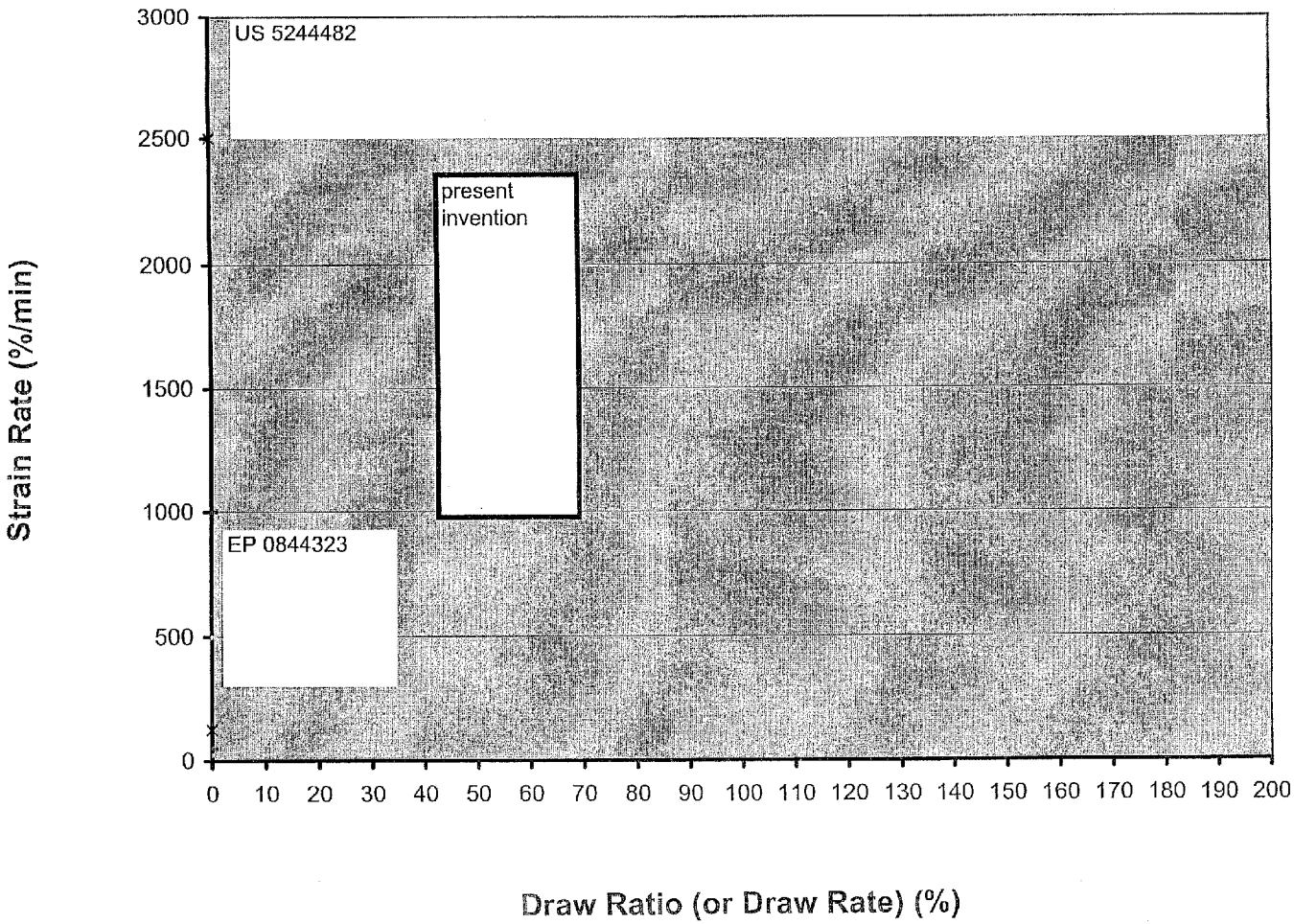
FIG. 4 is a graph showing the relationship of the present invention to U.S. Pat. No. 5,244,482 and EP 0 844 323 with regard to the parameters of the draw rate and the strain rate. The present invention provides a window of opportunity for increasing the process speed and improving the elastic properties, which only exists in the claimed area as shown by the examples.

Most importantly, the strain rate is not appropriate to be used to describe a process without specifying the two variables, the draw ratio, and the rate of the processing (the processing distance over the processing speed), since the same strain rates can be obtained with different combinations of parameters in the equation. Both U.S. Pat. No. 5,244,482 and EP 0 844 323 use the strain rate as the only parameter for defining their methods but without clarifying the rate of the processing and so there is no way of knowing how to come up the numbers of their strain rates. Still, there is no conflict of those previous descriptions with the present invention in the strain rates. Hassenboehler's invention claimed their method at strain rate at least 2500% per min, and Ward's invention claimed the range between 350% to 950% per min. The present invention operates in the range of 1000% to 2400% per min as shown by FIG. 4.

The invention claimed is:

1. A process of preparing an elastic thermally bonded nonwoven web, whereby the process is characterized by the following steps:

(i) providing a thermally bonded nonwoven precursor web containing thermoplastic fibers, (ii) subjecting the precursor web of step (i) to a drawing treatment in a machine direction, with an unwinding speed in a range of 150 m/min to 250 m/min, at a drawing rate of from 45 to 70%, and a strain rate within a range of from 1000 to 2400%/min at a temperature between the softening point and the melting point of the fibers for preparing the elastic thermally bonded nonwoven web.

2. The process according to claim 1, wherein the precursor web is unwound at a speed of at least 100 m/min during the drawing treatment.

3. The process according to claim 1, wherein the drawing treatment in step (ii) comprises introducing the thermally bonded nonwoven precursor web into a heating means for heating the web to a temperature between the softening point and the melting point of the fibers.

4. The process according to claim 1, which further comprises the step of cooling the web after the drawing treatment.

5. The process according to claim 1, wherein the precursor web contains polypropylene fibers.

6. The process according to claim 5, wherein the polypropylene fibers are contained in an amount of at least 30% by weight.

7. The process according to claim 1, wherein the precursor web contains cellulosic fibers.

8. The process according to claim 1, wherein the precursor web consists of polypropylene fibers.

9. The process according to claim 1, wherein the elastic nonwoven web has anisotropic elasticity properties.

10. The process of claim 9, wherein the ratio of elongation at break in machine cross direction to the elongation at break in machine direction is at least 800%.

11. The process according to claim 1, wherein said said nonwoven precursor web is a spunbonded web.

12. The process according to claim 1, wherein nonwoven precursor web is a melt blown web.

13. The process according to claim 1, wherein said said nonwoven precursor web is a carded thermally bonded nonwoven web.

14. The process according to claim 1, wherein said nonwoven web is a laminate containing two or more of the nonwoven webs according to claim 1, or a laminate of the nonwoven webs according claim and a thermoplastic film.

15. The process according to claim 1, wherein said thermally bonded nonwoven web is a blend of thermoplastic fibers and cellulosic fibers wherein said web contains at least 30% thermoplastic fibers.

16. The process according to claim 1, wherein the process is carried out continuously.

17. The continuous process according to claim 16, wherein the drawing treatment in step (ii) comprises unwinding the thermally bonded nonwoven web into a first variable tension means which feeds said web into a web heating means for heating the web to a temperature between the softening point and the melting point of the fibers, followed by continuously stretching the heated web lengthwise in the machine direction, cooling the web and collecting the cooled web.

18. A thereto-mechanical method for treating a nonwoven web according to claim 1, which comprises:

a. providing a thermally bonded polypropylene nonwoven web of carded, spunbond, SMS or SMMS as precursor web;

b. provide an unwinder roll and the winding roll in a distance of 6-10 meters;

c. continuously feeding the precursor web from the unwinder roll to the winding roll, wherein the speed of the unwinder rolls is in a range of from 150 m/min to 400 m/min;

d. heating the precursor web at a temperature between the softening temperature and melting temperature of the thermoplastic polypropylene;

e. drawing the heated web by increasing the speed of winding roll over the unwinder roll at least 45% and to 70%, to thereby reduce the width of the web by 50% to 65% whereby the f. strain rates are within the range of 1000% to 2400%/min.

19. The process according to claim 18, wherein after the unwinder roll is a pair of nip-rolls to make a S-wrap for creating the draw ratio and before the winding roll is a pair of nip-rolls to make a S-wrap to release the finished web to the winding roll.

20. The process according to claim 18, wherein the precursor web is a single layer or multiple layers construction that are thermally bonded or laminated.

* * * * *